US005971398A

United States Patent [19]

Broussard et al.

[11] Patent Number: 5,971,398

[45] Date of Patent: Oct. 26, 1999

[54] THREE DIMENSIONAL TRAINING MANNEQUIN WITH LIFELIKE REACTION AND FEEL FOR SPARRING AND SELF-DEFENSE TRAINING

[75] Inventors: David N. Broussard; Danny Ray Smith; Clinton H. Evans, all of Gatesville, Tex.

[73] Assignee: Medical Plastics Laboratory, Inc., Gatesville, Tex.

[21] Appl. No.: 09/055,823

[22] Filed: Apr. 6, 1998

Related U.S. Application Data

[63] Continuation-in-part of application No. 08/834,623, Apr. 14, 1997, Pat. No. 5,816,579, which is a continuation-in-part of application No. 08/775,865, Jan. 2, 1997, Pat. No. 5,792,032.

[51] Int. Cl.[6] ..... A63B 69/34; F41J 3/00

[52] U.S. Cl. ..... 273/408; 482/83

[58] Field of Search ..... 273/403, 404, 273/405, 406, 407, 408, 348, 390, DIG. 5; 473/600; 482/83

[56] References Cited

U.S. PATENT DOCUMENTS

| | | | |
|---|---|---|---|
| 4,373,733 | 2/1983 | Smith, Jr. | 273/381 |
| 4,725,058 | 2/1988 | Molitor | 473/600 |
| 5,281,191 | 1/1994 | DeSousa | 482/83 |
| 5,498,001 | 3/1996 | Franks et al. | 273/403 |
| 5,676,378 | 10/1997 | West | 273/390 |
| 5,792,032 | 8/1998 | Williams et al. | 482/83 |
| 5,816,579 | 10/1998 | Broussard et al. | 273/408 |

*Primary Examiner*—William H. Grieb

*Attorney, Agent, or Firm*—Locke Liddell & Sapp LLP

[57] ABSTRACT

A training mannequin for sparring and self-defense training is disclosed which employs a life-size mannequin torso in place of the traditional punching bags. The mannequin torso provides more realistic training and provides anatomically correct references as well as lifelike reaction and feel when struck. The mannequin is made from an outer skin filled with a flexible interior foam. The outer skin is formed from a flexible material which returns to its original shape even after it is deformed by a strong blow. This resilience allows the mannequin to absorb virtually unlimited blows without losing its shape, structure or feel. Further, the three dimensional nature of the mannequin allows training in realistic circumstances and from angles not possible with traditional punching bags.

20 Claims, 3 Drawing Sheets

THREE DIMENSIONAL TRAINING MANNEQUIN WITH LIFELIKE REACTION AND FEEL FOR SPARRING AND SELF-DEFENSE TRAINING

RELATED APPLICATIONS

This application is a continuation-in-part both of U.S. application Ser. No. 08/834,623, filed on Apr. 14, 1997, entitled Three Dimensional Mannequin for Marksmanship and Weapons Training Practice, now U.S. Pat. No. 5,816,579 and of U.S. application Ser. No. 08/775,865, filed on Jan. 2, 1997 entitled Training Mannikin now U.S. Pat. No. 5,792,032.

This invention relates to sparring and self-defense training. More particularly, the invention relates to sparring and training systems employing a mannequin which is formed to provide a lifelike look and feel when sparring.

BACKGROUND OF THE INVENTION

Traditionally, punching bags are formed from an outer shell filled with padding. The bags are usually geometrically shaped (for example, cylindrical, spherical or rectangular) and suspended with chains or the like from an overhead support. The standard cylindrical punching bag, while a useful training tool, does not provide anatomical reference points or lifelike feel and feedback when punched or kicked. Further, in sparring situations an opponent's shoulders are almost never square to the combatant. A right-handed opponent will be turned at an angle with his left shoulder closer to the combatant than his right. Opponents can also either be right-handed or left-handed. Left-handed opponents provide a much different target than do right-handed opponents, primarily due to the different stance which turns the opponent's shoulders opposite direction than those of the right-handed opponent. Traditional bags cannot simulate stance differences based on predominant hand. This limits their usefulness as training tools.

Additionally, different techniques are required for "fighting inside" than are used for normal sparring. "Fighting inside" can loosely be defined as encounters where the opponents are very close to one another or well within the reach of each other. When fighting inside, combatants usually assume a much more defensive posture which involves bending at the waist to give the opponent a smaller target to hit. Prior training bags are unable to simulate this technique and are inadequate for training a fighter to fight inside.

While three dimensional mannequins have existed for years, current mannequins are unsuitable for sparring and training for a variety of reasons. Most traditional mannequins are made from a hard plastic material. Hard plastic mannequins are unacceptable for sparring and training as they could injure the person punching or kicking them. Additionally, the hard nature of the mannequins would not simulate the feel of striking a human body.

SUMMARY OF THE INVENTION

In accordance with the present invention, a training system is provided which allows the person being trained to practice punching and kicking techniques under a variety of different situations. The present invention employs a substantially life-size mannequin torso in place of the standard punching bag or pad. The mannequin torso includes a head, shoulders, chest and midsection to provide anatomically defined aiming references for self-defense and fighting training.

Further, in accordance with the present invention, a training mannequin is provided which provides lifelike reaction and feel when sparring or training. The three dimensional mannequin includes an outer skin formed in the shape of a human being from a durable flexible material having a Shore 'A' durometer rating between 40 and 65. The outer skin is filled with a foam interior which has a free rise density between about 2.8 and 9.5 lbs. per cubic foot. A shatter-proof pole can be inserted into the mannequin to aid in mounting the mannequin for training. In the preferred embodiment, the outer skin is formed from a mixture of polyvinyl chloride and plasticizer where the plasticizer is 75–160 parts per hundred resin by weight. This results in a mixture that is about 9 to 10 lbs. of plasticizer per gallon of polyvinyl chloride, or about 30% to 60% plasticizer by volume. The foam interior is preferably formed from a flexible polyurethane.

The flexible material of the outer shell is designed to return substantially to its original shape after being deformed when struck. The flexible material of the outer skin has an elongation percentage between 200 and 300. The foam interior provides shape and mass to the training mannequin and can also be deformed without losing its shape or structure. A base and frame can be included which using in combination with the internal pole, allows the training mannequin to be positioned for various types of training. The base includes a weighted foundation and anchoring mechanisms. The frame inserts into the anchoring mechanisms and fits telescopically, with the internal pole allowing the height of the mannequin to be adjusted by use of height adjustment holes and an anchoring pin. The training mannequin can be rotated on the frame to enable training with the mannequin at any angle to the trainee to simulate the fighting stance of a left-handed or a right-handed opponent as well as approaches from any angle.

The features and advantages of the invention will become more readily understood from the following detailed description taken in conjunction with the appended claims and attached drawing wherein:

DESCRIPTION OF THE PREFERRED EMBODIMENTS

Figure 1:
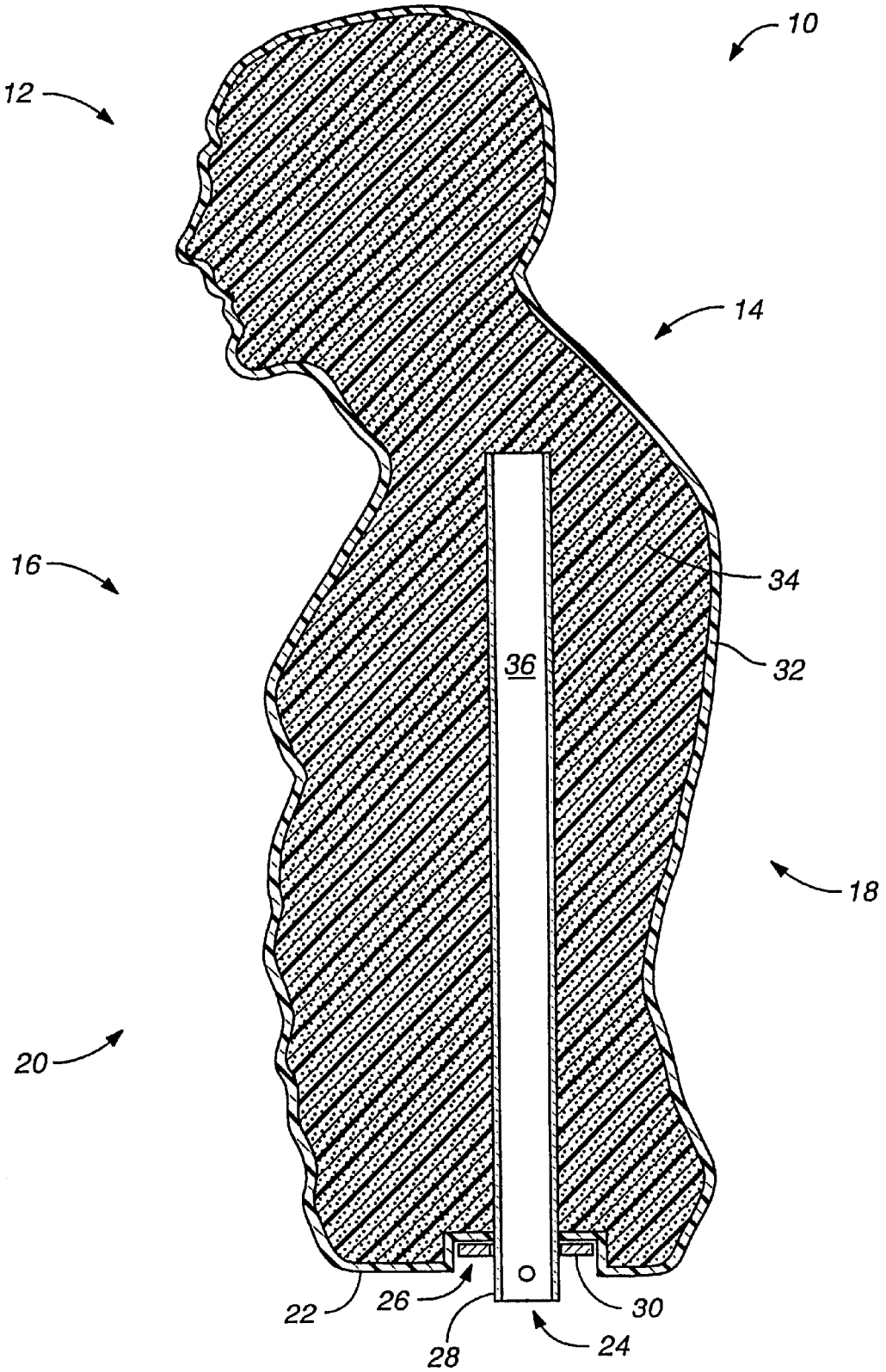
FIG. 1 is a sectional side view of the weapons training mannequin of the present invention.

Referring now to FIG. 1, the preferred embodiment of training mannequin 10 is shown in a sectional side view. In the preferred embodiment, mannequin 10 is in the form of a human torso having head 12, shoulders 14, chest 16, back 18 and midsection 20. Underside 22 of mannequin 10 is preferably formed with aperture 24 in the center of recess 26. Aperture 24 allows pole 28, or other standing device, to be inserted into mannequin 10. Retainer ring 30 can be used to hold mannequin 10 on pole 28.

Forming mannequin 10 in the shape of a three dimensional human torso allows for types of sparring and training not available before. While punching bags have been available for countless years, they do not provide anatomical reference points which can be used by the person being trained. Mannequin 10 of the present invention provides anatomical reference points which allow for much more realistic training than do standard punching bags. It is anatomically correct, not only from the front, but also from the sides, back and even the top. Mannequin 10 can be used to practice realistic approaches from any angle.

At least as important as the three dimensional and anatomically correct nature of mannequin 10 are the materials and construction which allow mannequin 10 to provide lifelike reaction to punches and kicks and to withstand years of sparring without losing its shape or feel. Mannequin 10 is formed essentially by skin 32 and foam interior 34. Skin 32 is formed from a flexible material which allows it to deform when struck without destroying the integrity of skin 32. Skin 32 is elastic enough to return to its original position after being struck and deformed. Foam interior 34 is used to fill the shell formed by skin 32. Foam interior 34 provides structure and mass to skin 32, allowing mannequin 10 to achieve the proper weight and firmness to give a lifelike feel when struck. The ability of outer skin 32 to return to its original shape after being struck, is what allows mannequin 10 to be a useful sparring target which can take hits from countless blows without losing its lifelike feel or structural integrity. Pole 28 allows mannequin 10 to be attached to a stand or other mechanism for proper positioning. Forming skin 32 from a flexible material and filling it with a foam interior allows mannequin 10 to react realistically to sparring blows. This allows trainees to get realistic feedback from their blows while training.

To obtain the desired resilience, skin 32 is formed from a material that has a hardness, as measured by a Shore 'A' durometer rating, from about 40 to 65. This should result in the material of skin 32 having an elongation percentage between 200 and 300, the elongation percentage being the amount the material can be stretched and still return to its original shape. Foam interior 34 allows skin 32 to maintain the form of a human torso and should have a density between about 2.8 and 9.5 lbs. per cubic foot.

In the preferred embodiment, skin 32 is formed from a mixture of polyvinyl chloride and a plasticizer. The mixture is from about 75 to 160 parts per hundred resin by weight. This results in the plasticizer being about 30% to 60% of the total mixture by volume, or about 9 to 10 lbs. of plasticizer per gallon of polyvinyl chloride. To form skin 32, the mixture of polyvinyl chloride and plasticizer is molded using a rotational-molding process to the desired thickness. Once skin 32 is formed, foam interior 34, which in the preferred embodiment is flexible polyurethane, is injected into skin 32 to give mannequin 10 a lifelike shape and feel. During the injection of foam interior 34, a form is positioned inside skin 32 to provide cavity 36 into which pole 28 will be inserted. Pole 28 can be formed from any material strong enough to withstand the forces placed on the mannequin during sparring. Any shape or size form may be used in creating cavity 36 to allow mannequin 10 to be used with existing training systems or bases already in use.

Figure 2:
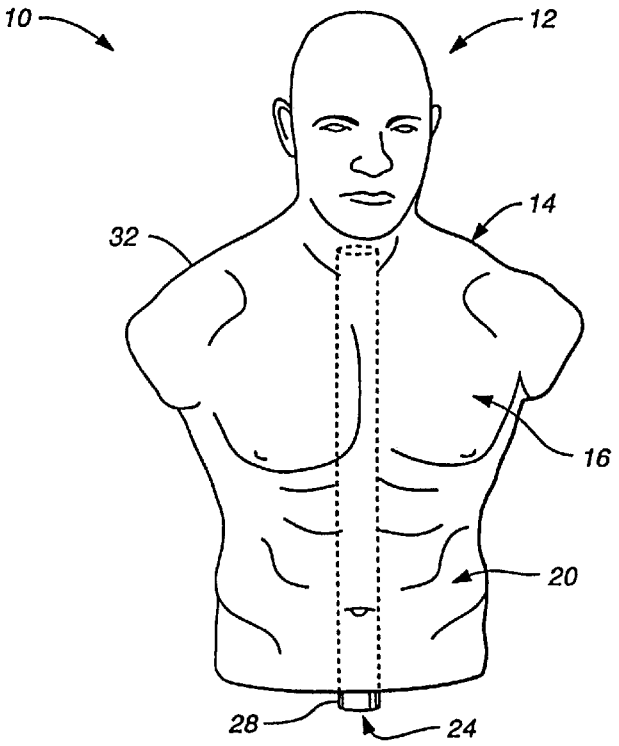
FIG. 2 is a frontal view of the weapons training mannequin of FIG. 1.
Figure 3:
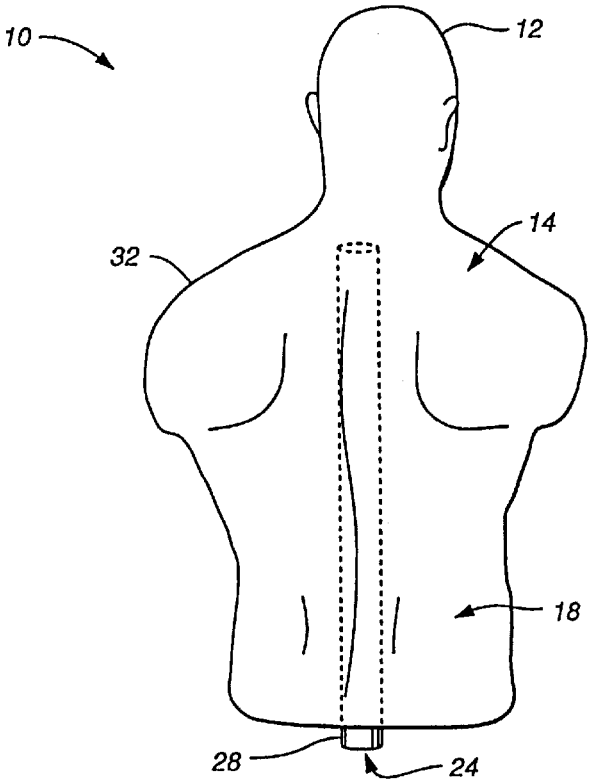
FIG. 3 is a back view of the weapons training mannequin of FIG. 1.

FIGS. 2 and 3 show a frontal view and a rear view, respectively, of mannequin 10 with pole 28 shown in phantom. FIGS. 2 and 3 show the realistic three dimensional nature of mannequin 10. Again, mannequin 10, in the preferred embodiment, includes head 12, shoulders 14, chest 16, back 18, and midsection 20 to provide realistic anatomically correct reference points for sparring and self-defense training. Although mannequin 10 only includes a torso, the present invention could easily be formed with arms, and or with hips and legs to form a full human body.

Figure 4:
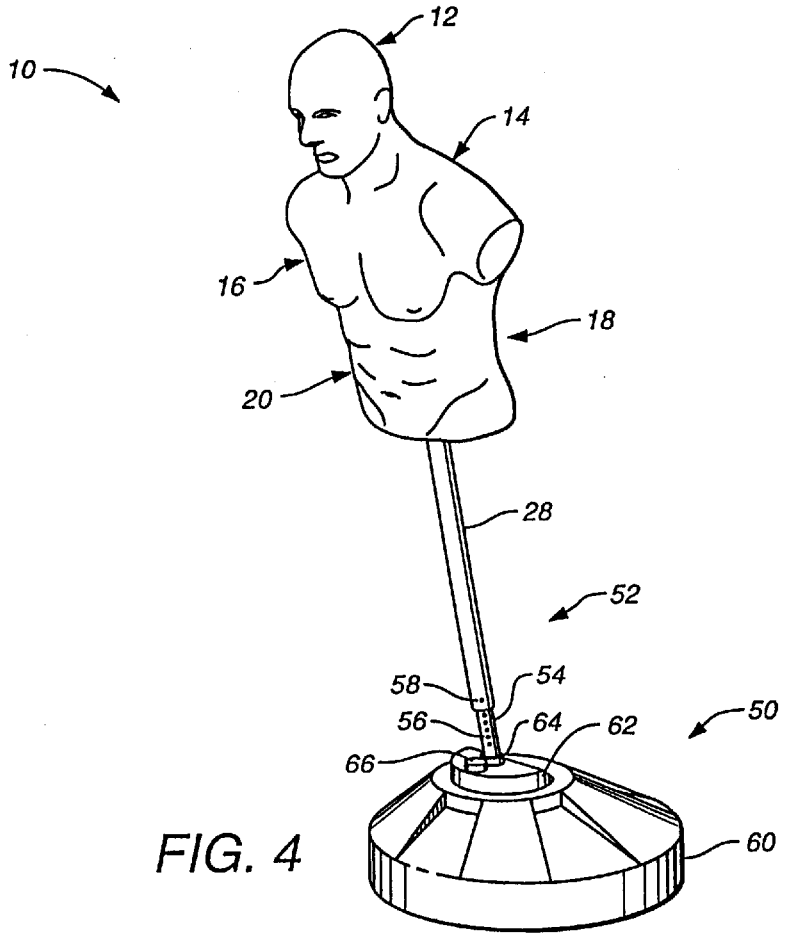
FIG. 4 is a perspective view of the weapons training mannequin torso attached to a frame which is mounted in a base in the angled forward position.
Figure 5:
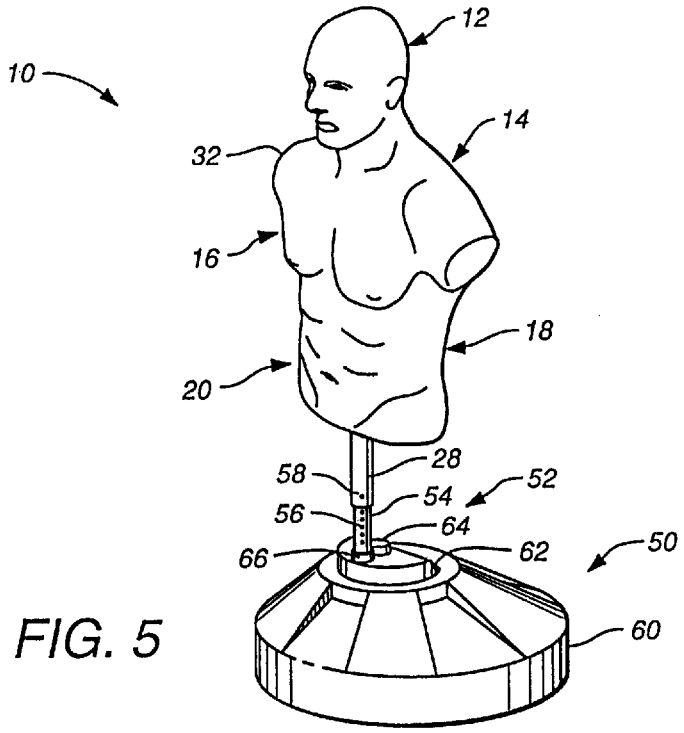
FIG. 5 is a perspective view of a weapons training mannequin torso attached to a frame which is mounted in a base in the vertical position.

Referring now to FIGS. 4 and 5, mannequin 10 can be used with base 50 and frame 52 to hold mannequin 10 in a fixed position at almost any angle to the trainee. As stated, mannequin 10 incorporates human features including head 12, shoulders 14, chest 16, and midsection 20 to provide anatomical reference points which can be used by the person being trained. These anatomical reference points provide for much more realistic training than do standard punching bags. Mannequin 10 also provides realistic anatomical reference points from the sides, back and top allowing training from any angle, something not possible with punching bags.

When using mannequin 10 on base 50, pole 28, or other standing device, is inserted into aperture 24 on the underside of mannequin 10 to secure frame 52 to mannequin 10. Frame 52 is used to hold mannequin 10 substantially above base 50. In the preferred embodiment, frame 52 is formed by frame pole 54 which telescopes into pole 28. In one embodiment, frame pole 54 has outer dimensions that correspond to the inner dimensions of pole 28 such that pole 28 slides over frame pole 54 allowing the height of frame 52 to be adjusted while still ensuring that frame 52 is rigid. Height adjustment holes 56 are provided in pole 28 or frame pole 54 and used in conjunction with pin element 58 to fix frame 52 at the desired height. The adjustable height of frame 52 allows mannequin 10 to simulate persons of varying height for training purposes. Ideally, frame 52 is adjustable to the extent that persons ranging in height from as little as five feet to as tall as six feet six inches or more can be simulated.

Frame 52 is secured in place by base 50. Base 50 includes weighted foundation 60 and anchoring portion 62 which hold anchoring mechanisms 64 and 66. In the preferred embodiment, anchoring mechanisms 64 and 66 are apertures into which frame 52 is inserted. Anchoring mechanism 64, into which frame 52 is inserted in FIG. 4, is an aperture formed at an angle such that when frame 52 is inserted, mannequin 10 is angled forward to simulate close in fighting. Mannequin 10 secured to base 50 in this manner allows for the close in fighting techniques to be simulated during sparring.

Referring now to FIG. 5, mannequin 10 is shown again with base 50, and again is supported on frame 52 which is held substantially upright by base 50. In FIG. 5, mannequin 10 is positioned in the vertical position, as opposed to angled forward as in FIG. 4, by placing frame 52 in anchoring mechanism 66 instead of anchoring mechanism 64. The vertical position shown in FIG. 5 is the standard position for mannequin 10 using base 50. To increase the effectiveness of mannequin 10, mannequin 10 may be rotated into alternate special orientations, as opposed to only square to the combatant. Rotating mannequin 10 along the axis of frame 52 allows mannequin 10 to simulate persons at angles to the trainee. These different angles allow the mannequin to simulate both left and right handed opponents, as well as opponents facing away from the trainee. These orientations cannot be simulated using standard punching bags.

In addition to the base and frame shown in FIGS. 4 and 5, the mannequin of the present invention is easily adaptable to other training apparatuses while maintaining the lifelike look and feel of the outer skin, foam interior combination of the present invention. Apparatuses such as those disclosed in U.S. Pat. No. 4,951,943, U.S. Pat. No. 5,050,872, and U.S. Pat. No. 5,152,733, all to Farenholtz, are perfect for use with the training mannequin of the present invention.

It is to be understood that although the invention has been described with particular reference to specific embodiments thereof, the form of the invention shown and described in detail is to be taken as the preferred embodiment of same, and that various changes and modifications may be resorted to without departing from the spirit and scope of the invention as defined by the appended claims.

What is claimed:

1. A three dimensional training mannequin comprising:

a) an outer shell formed in the shape of a human being, the outer shell formed from a durable flexible material having a durometer rating between about 40 and 65 Shore 'A'; and b) a foam interior inside the outer shell, the foam interior providing shape and mass to the training mannequin.

2. A three dimensional mannequin as described in claim 1 further comprising an internal pole inserted into the foam interior to allow attachment to a base.

3. A three dimensional mannequin as described in claim 1 wherein the foam interior includes a cavity sized and shaped to fit into an existing target system.

4. A three dimensional mannequin as described in claim 1 wherein the outer shell is formed from a polyvinyl chloride material mixed with a plasticizer.

5. A three dimensional torso as described in claim 4 wherein the plasticizer is about 75 to 160 parts per hundred by weight.

6. A three dimensional mannequin as described in claim 1 wherein the foam interior is formed from flexible polyurethane having a density from about 2.8 to 9.5 lbs. per cubic foot.

7. A three dimensional mannequin as described in claim 1 wherein the outer shell is formed in the shape of a human torso and head.

8. A three dimensional training mannequin comprising:

a) an outer shell made from a flexible material such that the flexible material substantially returns to an original position after being deformed when struck; and b) a foam interior formed from a separate material distinct from the outer shell, the foam interior inside the outer shell to support the outer shell in its desired shape, wherein the foam interior and the outer shell combine to provide lifelike reaction and feel.

9. A three dimensional mannequin as described in claim 8 wherein the flexible material is a polyvinyl chloride and plasticizer mixture having an elongation percentage between 200 and 300.

10. A three dimensional mannequin as described in claim 9 wherein the mixture contains between 9 and 10 lbs. of plasticizer per gallon of polyvinyl chloride.

11. A three dimensional mannequin as described in claim 8 further comprising an internal pole.

12. A three dimensional mannequin as described in claim 11 wherein the internal pole is a medium density polyethylene material.

13. A three dimensional mannequin as described in claim 8 wherein the foam interior is formed by a flexible polyurethane foam with a density between 2.8 and 9.5 lbs. per cubic foot.

14. A three dimensional mannequin for sparring and self-defense training comprising:

a) an outer shell in the shape of a human torso molded from a mixture of polyvinyl chloride and plasticizer; and b) a foam interior formed from flexible polyurethane having a density between 2.8 and 9.5 lbs. per cubic foot, wherein the outer shell and the foam interior provide lifelike reaction and feel when the three dimensional training mannequin is struck.

15. A three dimensional mannequin as described in claim 14 wherein the outer shell has a Shore 'A' durometer rating between 40 and 65.

16. A three dimensional mannequin as described in claim 14 wherein the outer shell has an elongation percentage between 200 and 300.

17. A three dimensional mannequin as described in claim 14 wherein the mixture is 30% to 60% plasticizer by volume.

18. A three dimensional mannequin as described in claim 14 wherein the mixture is made up of between 9 and 10 lbs. of plasticizer per gallon of polyvinyl chloride.

19. A three dimensional mannequin as described in claim 14 further comprising an internal pole which extends from a base of the mannequin.

20. A three dimensional mannequin as described in claim 19 further comprising a stand, the stand receiving the internal pole.

* * * * *